US006698251B1

(12) United States Patent
Smyre et al.

(10) Patent No.: US 6,698,251 B1
(45) Date of Patent: Mar. 2, 2004

(54) DOUBLE-SIDED CROCHET-KNITTED MATTRESS CLOSING TAPE

(75) Inventors: Ivan J. Smyre, Greensboro, NC (US); William B. Barnhardt, Charlotte, NC (US)

(73) Assignee: Southern Webbing Mills, Inc., Greensboro, NC (US)

( * ) Notice: Subject to any disclaimer, the term of this patent is extended or adjusted under 35 U.S.C. 154(b) by 0 days.

(21) Appl. No.: 10/339,118

(22) Filed: Jan. 9, 2003

(51) Int. Cl.[7] ..... D04B 23/12
(52) U.S. Cl. ..... 66/193
(58) Field of Search ..... 66/190, 191, 192, 66/193, 194, 195, 202; 442/314

(56) References Cited

U.S. PATENT DOCUMENTS

| | | | | | |
|---|---|---|---|---|---|
| 3,027,738 | A | | 4/1962 | Turton | 66/195 |
| 3,757,540 | A | * | 9/1973 | Jackson | 66/192 |
| 3,886,768 | A | * | 6/1975 | Anderson | 66/195 |
| 4,172,372 | A | | 10/1979 | Murakami | 66/195 |
| 5,191,777 | A | * | 3/1993 | Schnegg | 66/195 |
| 5,267,454 | A | * | 12/1993 | Gregory | 66/196 |
| 5,290,619 | A | | 3/1994 | Siegel et al. | 428/102 |
| 5,331,697 | A | | 7/1994 | Siegel et al. | 5/474 |
| 5,472,766 | A | | 12/1995 | Siegel et al. | 428/102 |
| 5,711,169 | A | | 1/1998 | Leeke et al. | 66/196 |
| 5,855,125 | A | | 1/1999 | Lohmueller et al. | 66/196 |
| 6,006,550 | A | * | 12/1999 | Singh | 66/13 |
| 6,082,147 | A | | 7/2000 | Rock et al. | 66/191 |
| 6,196,032 | B1 | | 3/2001 | Rock et al. | 66/195 |
| 6,477,865 | B1 | * | 11/2002 | Matsumoto | 66/195 |

* cited by examiner

*Primary Examiner*—Danny Worrell
(74) *Attorney, Agent, or Firm*—Kennedy Covington Lobdell & Hickman, LLP

(57) ABSTRACT

A mattress closing tape formed of a crochet-type warp knitted construction comprises a set of parallel warp yams knitted in a series of lengthwise-extending chain stitches, first and second base filling yams of a first color (or other visual indicia) inlaid widthwise in opposing relation to each other through the chain stitches of the warp yarns to form a base fabric layer predominantly of such color at one fabric face, and third and fourth sets of multiple pattern filling yarns of a differing color (or visual indicia) inlaid diagonally in opposing relation to one another beneath the underlaps of the warp yarns to form a diamond pattern layer predominantly of such differing color at the opposite fabric face.

21 Claims, 4 Drawing Sheets

Gauge: 14
Needles: 24
Thread-guides: 44
Eyelets: 0
Bars: 4
Links: 48

| | | | | |
|---|---|---|---|---|
| Take-down rollers | A: | 0 | B: | 0 |
| AL.3R | C: | 0 | D: | 0 |
| AL.3RDF/AL.3RS | E: | 0 | F: | 0 |
| AL.POS/C | G: | 0 | H: | 0 |

Stitches per cm: 30 Elasticity: 0

| | | | |
|---|---|---|---|
| Elastic threads | Type | Count | Total: 0 |
| Warp threads | Type Tuntex Poly | Count 1/150 | Total: 24 |

| Weft Threads | Type | Count | Thread-guides | Threads per thread-guide | Total |
|---|---|---|---|---|---|
| Bar 1: | Tuntex Poly | 1/150 | 21 | 1 | 21 |
| Bar 2: | Tuntex Poly | 1/150 | 21 | 1 | 21 |
| Bar 3: | Flat Bright Poly Dillion | 1/150/48 100% Poly Bright A.D. | 1 | 3 | 3 |
| Bar 4: | Tuntex Poly | 1/150 | 1 | 5 | 5 |

Machine: 407
RPM: 1000
Hourly production rate per band (m): 17.00
Total hourly production (m): 119.00

Needle grooves: 221
Performance coefficient: 0.85
Bands obtainable contemporaneously: 7

Notes

Stitches equals picks. Run bright poly, each end separated in reed.

Fig. 4

DOUBLE-SIDED CROCHET-KNITTED MATTRESS CLOSING TAPE

BACKGROUND OF THE INVENTION

The present invention relates generally to narrow width textile fabric bands and tapes and, more particularly, to a narrow-width textile fabric tape of a crochet-knitted structure adapted particularly for use as a mattress closing tape.

In the manufacture of conventional mattresses, box springs and the like, a bead or cord is typically enclosed within a narrow-width fabric band or tape which is sewn with the fabric covering of the mattress or box spring at the edges defining one or both of the upper and lower perimeters of the mattress or box spring in order to form a finished border thereat. Conventionally such narrow-width bands or tapes are formed of a relatively stiff fabric material, typically of a woven construction, which provides durability against abrasion but disadvantageously produces a relatively rough feel and hand which can detract from the comfort of the mattress and/or box spring. In addition, the stiffiess of such conventional tapes tends to result in folds or puckers in the tape when sewn into a mattress construction, particularly at the corners of the mattress, which further detracts from the aesthetic appearance of the mattress as well as further detracting from the feel and comfort of the mattress border.

More recently, attempts have been made to produce aesthetically pleasing and functional mattress closing tapes of a knitted fabric construction, typically a crochet-knitted narrow-width band or tape. Representative examples have been offered commercially or produced by the C.T. Nassau Company and American Textile Tape Company. While these knitted mattress closing tapes have begun to achieve a modest level of acceptance within the bedding industry, such products either lack the aesthetic patterning available with conventional woven mattress tapes (as with the C.T. Nassau Company product) and/or have been of comparable stiffness to the known woven mattress tapes (as with the American Textile Tape Company product) so as to thereby fail to overcome the aforementioned disadvantages thereof. Another disadvantage of both conventional woven mattress closing tapes as well as the more recently introduced crochet-knitted tapes is that the tapes must be made and inventoried in a number of differing colors corresponding to all of the differing colors in which the mattresses themselves are produced.

SUMMARY OF THE PRESENT INVENTION

It is accordingly an object of the present invention to provide a novel and improved mattress closing tape of a fabric construction which enables a differing color (or other visual indicia) to be imparted to the opposite faces of the tape such that a single tape is usable reversibly with either of two differing mattress colors, thereby reducing the tape inventory requirements for mattress manufacturers. A more particular object of the present invention is to make the present mattress closing tape of a crochet knitted fabric construction which achieves an aesthetically pleasing surface patterning while maintaining a desirably flexible fabric structure which will closely conform to a mattress bead or cord with minimal, if any, puckering or folding.

Briefly summarized, the mattress closing tape of the present invention is produced on a crochet-type warp knitting machine having multiple warp yarns and multiple filling yarns forming a base fabric layer of one color, or other visual indicia, at one face of the tape and an opposing fabric layer of a differing color, or visual indicia, at the opposite face of the tape. In a preferred embodiment, the warp yarns comprise a single warp of multiple warp yarns inter-knitted with at least two, and more preferably at least four, differentially knitted filling yarns. The warp yarns are formed into crochet-type chain stitches extending lengthwise along the tape fabric. A first single base filling yarn and a second single base filling yarn, each of a first selected color or visual indicia, traverse weftwise, i.e., laterally, back and forth across all of the warp yarns through the individual chain stitch loops to form the base fabric structure. A set of multiple third pattern filling yarns and a set of multiple fourth pattern filling yarns, each of a second differing selected color or visual indicia, are knitted into the fabric structure at spacings (preferably uniform spacings) across the width of the tape fabric, each of the pattern filling yarns traversing back and forth across a few respective ones of the warp yarns according to respective pre-selected traversal patterns, thereby to produce the opposing layer of the tape fabric with a patterned effect. Preferably the pattern filling yarns traverse diagonally in opposition to one another in symmetrical patterns which thereby produce a pattern of a diamond-like appearance. In the preferred embodiment, the base filling yarns are knitted at the technical face of the fabric, to present the first color or visual indicia thereat, while the sets of the pattern filling yarns are knitted at the technical back of the fabric, to present the second color or visual indicia thereat. It is further preferred that the sets of the pattern filling yarns be fed at a slightly retarded or delayed timing relative to the base filling yarns and the warp yarns so as to not be captured within the chain stitch loops of the warp yarns but instead are captured by the underlaps extending between the chain stitch loops at the technical back of the fabric.

BRIEF DESCRIPTION OF THE DRAWINGS

FIG. 4 is a chart setting forth the technical specifications for the yarns and machine settings for knitting the mattress closing tape of FIG. 1;

DESCRIPTION OF THE PREFERRED EMBODIMENT

Figure 3:
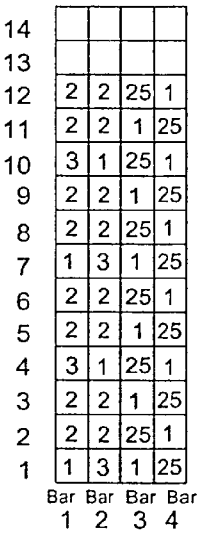
FIG. 3 is a schematic diagram depicting the layered configuration of the filling yarns in the mattress closing tape of FIG. 1, similarly keyed to the schematic diagram of FIG. 1.
Figure 1:
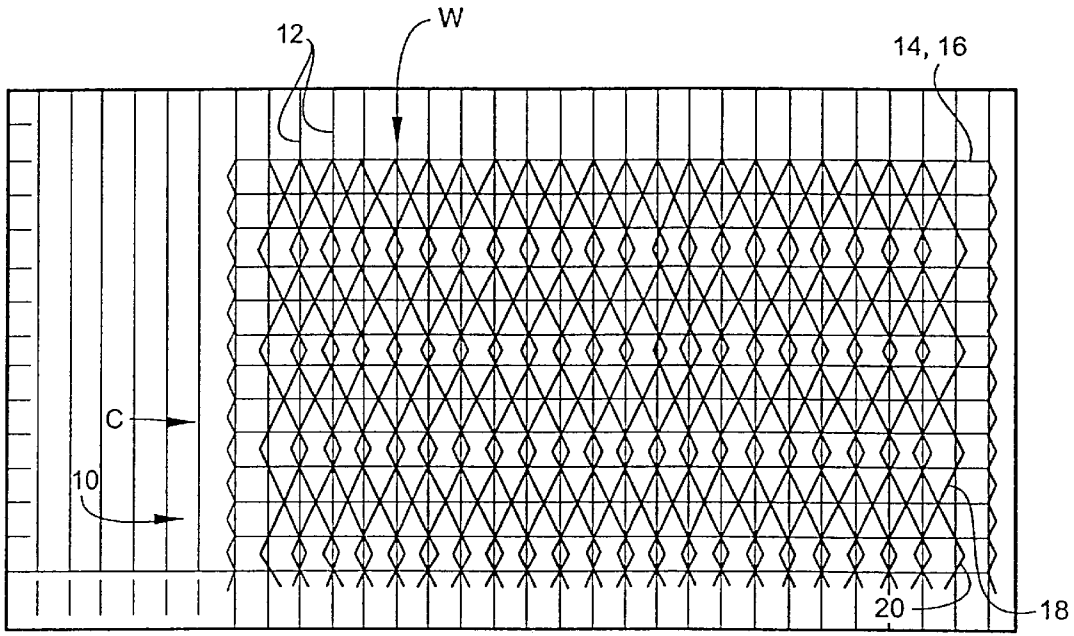
FIG. 1 is a schematic diagram depicting the stitch construction of a mattress closing tape in accordance with the preferred embodiment of the present invention, in a top plan view.
Figure 2:
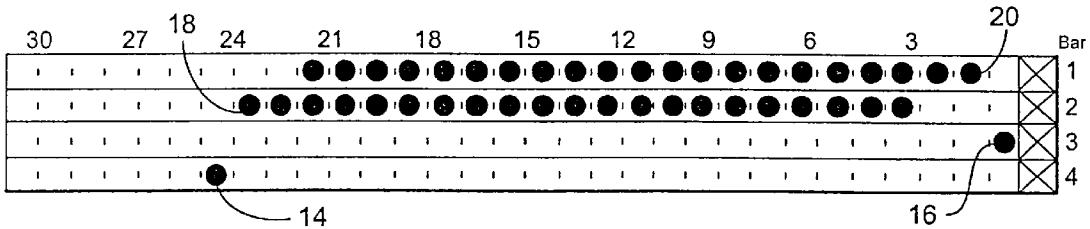
FIG. 2 is a chart setting forth the numerical stitch notation for the shogging patterns respectively followed by the filling yarns in the mattress closing tape of FIG. 1, keyed in correspondence to the schematic diagram of FIG. 1.

With reference now to the accompanying drawings and initially to FIGS. 1–3, a preferred embodiment of a mattress closing tape in accordance with the present invention is depicted schematically at 10 in such drawings. The mattress closing tape is preferably fabricated on a crochet-type warp knitting machine such as manufactured by the Comez Company of Italy, but as those persons skilled in the relevant art and industry will recognize and understand, many other crochet and warp knitting machines may likewise be utilized to produce the same and similar mattress closing tape fabrics. FIG. 4, as above-indicated, sets forth technical specifications for the individual yarns to be utilized in manufacturing the mattress closing tape and the machine settings of the warp knitting machine appropriate for manufacturing the construction depicted in FIG. 1.

Basically, the mattress closing tape 10 comprises a single set of warp yarns 12 fed from a single warp beam (not shown) or other suitable feeding mechanism. In the preferred form of the tape 10 depicted in FIGS. 1–3, the warp comprises 24 warp yarns 12 fed into the warp knitting machine in conventional fashion in the form of a sheet of the warp yarns traveling in parallel side-by-side form. The tape 10 further includes four differing fillings 14, 16, 18, 20, respectively, fed weftwise, i.e., laterally, with respect to the warp yarns 12 by means of four differing filling feed bars designated in FIGS. 1–4 as Bars 1, 2, 3 and 4. The first filling 14 comprises a single base filling yarn fed by Filling Bar 4 to traverse laterally back-and-forth across the full width of the warp sheet of yarns 12. Similarly, the second filling 16 comprises a single base filling yarn fed by Filling Bar 3 to traverse across the full width of the warp sheet of yarns 12 but in mirror-image opposition to the filling yarn 14. The third filling 18 comprises a set of multiple pattern filling yarns (in the preferred embodiment, a total of 21 filling yarns 18) fed in uniformly spaced side-by-side relation by Filling Bar 2 to traverse weftwise back-and-forth laterally relative to the warp sheet of yarns 12 in reciprocal shogging movements of the Filling Bar 2 of an amount corresponding to the spacing of two warp yarns 12. The fourth filling 20 similarly comprises a set of plural uniformly spaced pattern filling yarns (also preferably, a total of 21 filling yarns 20 in the illustrated construction) fed by Filling Bar 1 which likewise shogs back-and-forth laterally relative to the warp sheet of yarns 12 in reciprocating movements equivalent to the spacing of two warp yarns 12, but in mirror-image opposed relation to the filling yarns 18 of Filling Bar 2. According to the present invention, the yarns of the first and second fillings 14, 16 are of a first selected color, or other visual indicia, while the yarns of the third and fourth fillings 18, 20 are of a second selected color, or other visual indicia, which is differing or contrasting to that of the first and second fillings.

In conventional fashion, the warp knitting machine manipulates the warp yarns 12 by means of a needle bar (not shown) of the machine to form each warp yarn 12 into a series of sequential uniformly-spaced chain stitches extending lengthwise along the tape 10 in parallel relation with each other warp yarn 12, the chain stitches thereby being aligned in parallel lengthwise extending wales W along the full length of the tape and weftwise (i.e. widthwise) parallel courses C. As the chain stitches of the warp yarns 12 are being formed in each sequential course, the Fillings Bars 3 and 4 inlay the respective base filling yarns 16, 14 within the loops of the chain stitches of each course C, thereby forming a base fabric structure which appears predominantly in the selected first color or visual indicia at the technical face of the fabric. Simultaneously, the Filling Bars 1 and 2 inlay their respective sets of pattern filling yarns 20, 18, each across two warp yarns 12, whereby the pattern filling yarns 18, 20 form a patterned layer of the tape 10 predominantly in the selected second color or visual indicia at the technical back of the fabric structure, with the opposing motions of the Filling Bars 1 and 2 forming the pattern filling yarns in a diamond-like pattern as depicted in FIG. 1. Preferably, the timing of the motions of the Filling Bars 1 and 2 is slightly retarded or delayed relative to the manipulation of the warp yarns 12 by the needle bar and the manipulation of the base filling yarns 14, 16 by Filling Bars 3 and 4 so that the pattern filling yarns 18 and 20 are not inlaid through the loops of the chain stitches of the warp yarns 12 but instead are inlaid underneath the underlaps of the warp yarns 12, i.e., the lengthwise segments of the warp yarns extending between the successive chain stitches.

Figure 7:
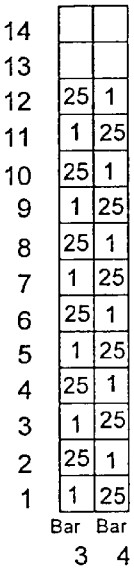
FIGS. 5, 6, and 7, are diagrams corresponding respectively to FIGS. 1, 2 and 3, but depicting separately the first and second base filling yarns of the mattress closing tape of FIG. 1.
Figure 5:
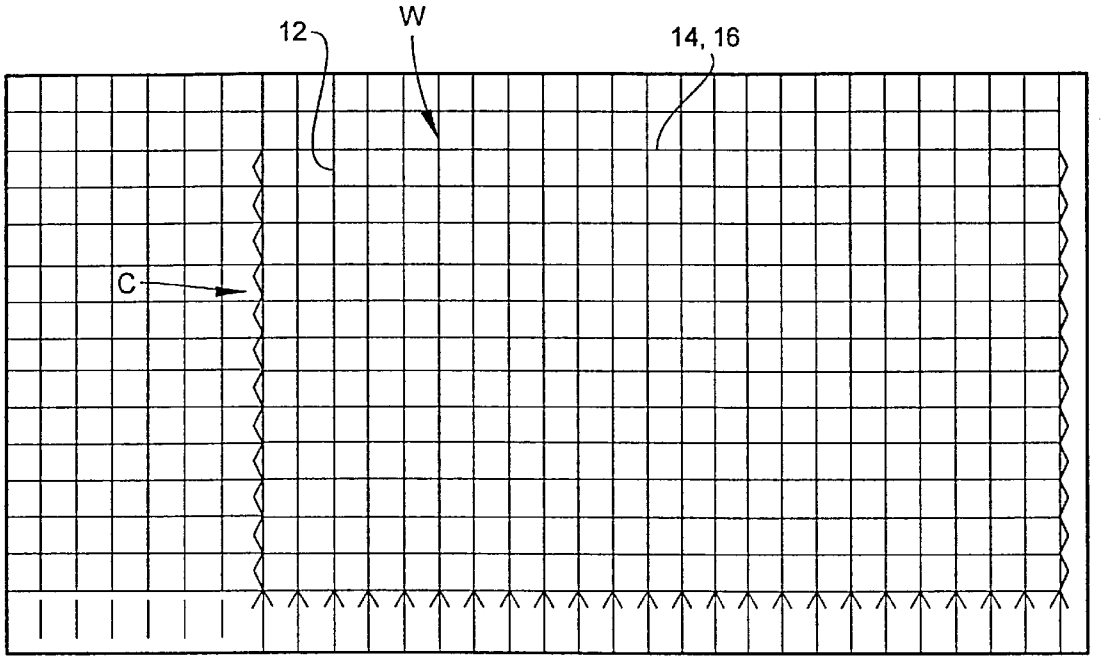
Figure 6:
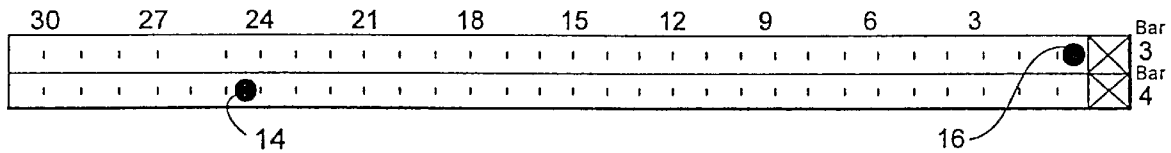
Figure 8:
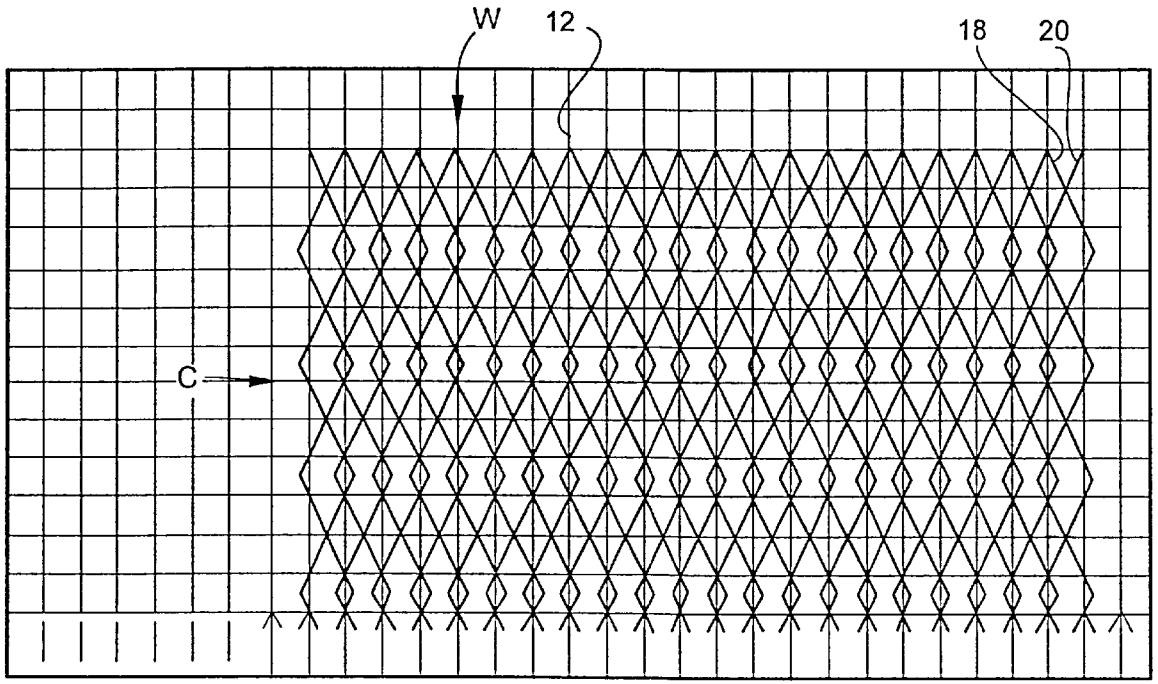
FIGS. 8, 9 and 10 are diagrams corresponding respectively to FIGS. 1, 2 and 3, but depicting separately the sets of third and fourth pattern filling yarns of the mattress closing tape of FIG. 1.
Figure 10:
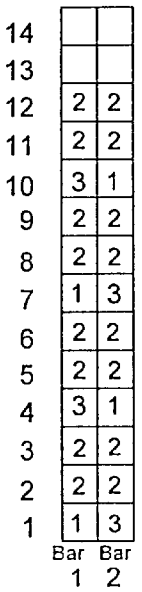
Figure 9:
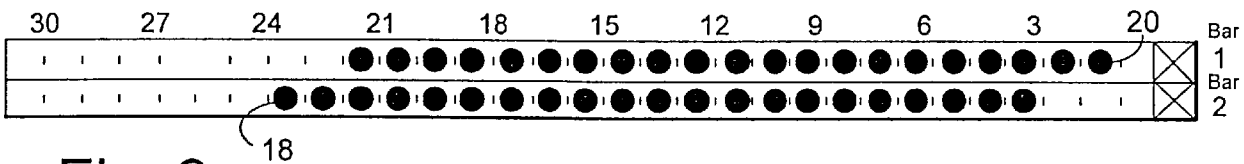

For further clarity, the individual patterns of the base filling yarns 14, 16 executed by Filling Bars 3 and 4 are depicted separately in FIGS. 5–7 and similarly, the individual patterns of the two sets of pattern filling yarns 18, 20 executed by Filling Bars 1 and 2 are separately depicted in FIGS. 8–10.

As those persons skilled in the art will recognize and understand, the crochet knitted fabric of the tape 10 provides unique advantages in the use of such tape as a mattress closing tape in the fabrication of mattresses and other bedding products. Most notably, the crochet-knitted fabric structure forms the base fillings 14, 16 and the pattern fillings 18, 20 in substantially distinct fabric layers at the opposite faces of the fabric structure thereby presenting the differing colors, or visual indicias, of the base and pattern fillings predominantly at the respectively opposing technical face and technical back of the fabric structure of the tape. In this manner, a single mattress closing tape according to the present invention, has a double-sided character which enables it to be used reversibly as either of two differently colored tapes. As a result, the inventoried amount of mattress closing tapes for a mattress manufacture, and the attendant storage space and cost thereof, can be reduced by about one-half in comparison to the use of know mattress closing tapes.

Apart from the above advantages, the specific construction of the tape 10 not only provides a desirable level of stiffness across the width of the tape but also is sufficiently flexible to be readily conformable laterally and lengthwise about a cord or bead utilized about the perimeter of a mattress or other bedding or similar product, with minimal, if any, folding or puckering. The tape 10 has sufficient natural flatness and dimensional stability to be easily handled during sewing of the tape into a mattress, enabling more uniform seams to be produced. The pattern executed by the pattern fillings 18, 20 provides a decorative and aesthetically pleasing appearance to the technical back of the fabric. Moreover, by fabricating the tape 10 on a crochet knitting machine, numerous other patterning possibilities become available. The multiple layers produced by the four fillings of the tape fabric provide sufficient thickness to lend depth to the tape, enhancing the feel and appearance of the fabric and further enhancing the patterned appearance.

Likewise, those persons skilled in the relevant art and industry will recognize and understand that numerous variations and modifications may be made in the tape of the present invention without departing from the scope and the substance of the invention. For example, the use of additional fillings, variations in the sizes and types of the filling and warp yarns, and variations in the stitch patterns executed by the Filling Bars 1 and 2, will enable the selective engineering of the physical characteristics of the fabric. These and other variations are intended to be within the scope and the substance of the present invention.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents.

What is claimed is:

1. A mattress closing tape comprising a flat narrow width textile fabric band having a crochet-knitted structure comprised of a set of warp yarns and multiple fillings inter-knitted to produce a base fabric layer presenting a first non-structural visual indicia at one fabric face and an opposing fabric layer presenting a second differing non-structural visual indicia at an opposite fabric face.

2. A mattress closing tape according to claim 1, wherein the first and second visual indicia are differing colors.

3. A mattress closing tape according to claim 1, further comprising at least two fillings.

4. A mattress closing tape according to claim 2, wherein the at least two fillings comprise a base filling at the one fabric face to form a base fabric structure and a pattern filling at the opposite fabric face to form a predetermined pattern.

5. A mattress closing tape according to claim 4, wherein the base filling is formed at the technical face of the tape and the pattern filling is formed at the technical back of the tape.

6. A mattress closing tape according to claim 3, wherein the base filling comprises a single filling yarn, and the pattern filling comprises multiple filling yarns.

7. A mattress closing tape according to claim 1, further comprising at least four fillings.

8. A mattress closing tape according to claim 7, wherein the at least four fillings comprise two base fillings traversing the full widthwise extent of the tape at the one fabric face to form a base fabric structure and two pattern fillings traversing relative to one another at the opposite fabric face to form a predetermined pattern.

9. A mattress closing tape according to claim 8, wherein the base fillings are formed at the technical face of the tape and the pattern fillings are formed at the technical back of the tape.

10. A mattress closing tape according to claim 8, wherein one base filling comprises a single filling yarn, the other base filling comprises a single filling yarn, one pattern filling comprises multiple filling yarns and the other pattern filling comprises multiple filling yarns.

11. A mattress closing tape according to claim 8, wherein the base fillings traverse in opposing mirror-image relation to one another and the pattern fillings traverse in opposing mirror-image relation to one another.

12. A mattress closing tape according to claim 11, wherein the pattern fillings form a diamond pattern.

13. A mattress closing tape comprising a set of warp yarns and multiple fillings inter-knitted in a crochet-type warp knitted construction to produce a base fabric layer presenting a first color at one fabric face and an opposing fabric layer presenting a second differing color at an opposite fabric face, wherein the multiple fillings comprise a base filling at the one fabric face to form a base fabric structure and a pattern filling at the opposite fabric face to form a predetermined pattern.

14. A mattress closing tape according to claim 13, wherein the base filling is formed at the technical face of the tape and the pattern filling is formed at the technical back of the tape.

15. A mattress closing tape according to claim 13, wherein the base filling comprises a single filling yarn, and the pattern filling comprises multiple filling yarns.

16. A mattress closing tape according to claim 13, further comprising at least four fillings.

17. A mattress closing tape according to claim 16, wherein the at least four fillings comprise two base fillings traversing the full widthwise extent of the tape at the one fabric face to form a base fabric structure and two pattern fillings traversing relative to one another at the opposite fabric face to form a predetermined pattern.

18. A mattress closing tape according to claim 17, wherein the base fillings are formed at the technical face of the tape and the pattern fillings are formed at the technical back of the tape.

19. A mattress closing tape according to claim 17, wherein one base filling comprises a single filling yarn, the other base filling comprises a single filling yarn, one pattern filling comprises multiple filling yarns and the other pattern filling comprises multiple filling yarns.

20. A mattress closing tape according to claim 17, wherein the base fillings traverse in opposing mirror-image relation to one another and the pattern fillings traverse in opposing mirror-image relation to one another.

21. A mattress closing tape according to claim 20, wherein the pattern fillings form a diamond pattern.

* * * * *